US005551757A

United States Patent [19]

Glover

[11] Patent Number: 5,551,757

[45] Date of Patent: Sep. 3, 1996

[54] FASTENING SYSTEM READY-TO-ASSEMBLE FURNITURE

[75] Inventor: Lanny R. Glover, New Albany, Miss.

[73] Assignee: Universal Furniture Industries, Inc., High Point, N.C.

[21] Appl. No.: 500,021

[22] Filed: Jul. 10, 1995

Related U.S. Application Data

[63] Continuation of Ser. No. 227,153, Apr. 13, 1994, abandoned.

[51] Int. Cl.[6] ..... A47C 17/86

[52] U.S. Cl. ..... 297/440.23; 297/440.15; 297/354.12

[58] Field of Search ..... 297/440.1, 440.15, 297/440.16, 440.22, 440.23, 354.1, 354.12

[56] References Cited

U.S. PATENT DOCUMENTS

| | | | |
|---|---|---|---|
| 1,366,820 | 1/1921 | Minnick et al. . | |
| 2,914,118 | 11/1959 | Sawyers | 297/440.23 |
| 3,083,496 | 4/1963 | Feinerman . | |
| 3,129,472 | 4/1964 | Hensel . | |
| 3,201,805 | 8/1965 | Smith . | |
| 3,248,147 | 4/1966 | Testa . | |
| 3,311,408 | 3/1967 | Sarvas . | |
| 3,658,382 | 4/1972 | Anderson . | |
| 3,695,690 | 10/1972 | Carson . | |
| 3,756,657 | 9/1973 | Johnson . | |
| 3,774,966 | 11/1973 | Faulkner . | |
| 3,799,611 | 3/1974 | Steinfeld . | |
| 3,842,456 | 10/1974 | Bronstien, Jr. . | |
| 3,871,041 | 3/1975 | Plume . | |
| 3,951,558 | 4/1976 | Komarov . | |
| 3,966,340 | 6/1976 | Morris . | |
| 4,012,155 | 3/1977 | Morris . | |
| 4,025,216 | 5/1977 | Hives . | |
| 4,165,902 | 8/1979 | Ehrlich . | |
| 4,204,287 | 5/1980 | Lane et al. . | |
| 4,261,667 | 4/1981 | Ervin et al. . | |
| 4,292,003 | 9/1981 | Pond . | |
| 4,305,616 | 12/1981 | Martinez . | |
| 4,365,840 | 12/1982 | Kehl et al. . | |
| 4,395,071 | 7/1983 | Laird . | |
| 4,621,381 | 11/1986 | Schramek . | |
| 4,668,011 | 5/1987 | Fister, Jr. . | |
| 4,691,965 | 8/1987 | Hsiung . | |
| 4,711,495 | 12/1987 | Madger . | |
| 4,883,331 | 11/1989 | Mengel . | |
| 4,886,326 | 12/1989 | Kuzyk . | |
| 4,893,958 | 1/1990 | Wieland . | |
| 4,919,485 | 4/1990 | Guichon . | |
| 4,932,720 | 6/1990 | Sherman . | |
| 4,944,627 | 7/1990 | Durney . | |
| 5,007,681 | 4/1991 | Meier et al. . | |
| 5,069,506 | 12/1991 | Wieland . | |
| 5,080,438 | 1/1992 | Moyer . | |
| 5,135,284 | 8/1992 | Crum . | |
| 5,338,095 | 8/1994 | Laughlin et al. | 297/440.1 |

FOREIGN PATENT DOCUMENTS

| | | | |
|---|---|---|---|
| 1222070 | 2/1971 | United Kingdom | 297/440.23 |

*Primary Examiner*—Peter R. Brown
*Attorney, Agent, or Firm*—Edgar A. Zarins; Malcolm L. Sutherland

[57] ABSTRACT

A fastening system for a ready-to-assemble furniture piece to facilitate the secure assembly of the components of the piece. The components of the RTA furniture piece include a front section, back section and opposing arm sections interconnected by the fastening system to support a seat or bed platform. The fastening system employs side support rails secured to the arm sections of the seat which allow either a seat platform or a foldout bed platform to be secured within the furniture piece. The rails include a front end bracket for securing the front section to the two arm sections. A rear bracket of the rails includes a pin connector for receiving the rear section of furniture piece. The rear bracket has a support pad for maintaining the seat back of a desired angle. The side support rails facilitate the quick and simple attachment of either a seat platform or a sleeper platform to the furniture piece using a series of hard bolts.

19 Claims, 4 Drawing Sheets

FASTENING SYSTEM READY-TO-ASSEMBLE FURNITURE

This is a continuation of application(s) Ser. No. 08/227,153 filed on Apr. 13, 1994, now abandoned.

BACKGROUND OF THE INVENTION

1. Field of the Invention

This invention relates to knock-down or ready-to-assemble furniture and, in particular, to a simple system of fastening the components together to form the furniture piece with sufficient reliability to support the user.

2. Description of the Prior Art

Historically, furniture pieces are manufactured and assembled at the factory and then shipped as a complete unit to the distributor or customer. The sections of the piece are joined by large bolts which extend through predrilled holes in the sections. In some furniture, the assembly is covered with upholstery partially concealing the bolts. The resulting assembly can be cumbersome to deliver to the customer or simply transport from one location to another. Additionally, the size of the furniture piece may make delivery to certain locations impossible because of dimensional constraints in hallways, doorways and stairways. As a result, customers may have limited selection of furniture because of the size and weight of fully assembled furniture pieces.

Knock-down (KD) or ready-to-assemble (RTA) furniture has been developed in order to overcome such shortcomings and to provide increased options in the storage, delivery and moving of furniture. Unfortunately, early versions of ready-to-assemble furniture lacked strength and stability particularly under heavy loads. The furniture was perceived as flimsy and unreliable particularly as to the means for fastening the components of the furniture pieces. Screws or bolts were used to secure the components which tend to loosen upon extended use resulting in a breakdown of the piece. Such fasteners also do not lend themselves to quick and simple disassembly of the furniture piece requiring tools for removal of the bolts or screws. In some instances, repeated assembly and disassembly of the furniture piece may strip the fasteners ultimately resulting in their failure. Additional problems result from attempting to make upholstered furniture ready-to-assemble since the fasteners need to be concealed.

SUMMARY OF THE PRESENT INVENTION

The present invention overcomes the disadvantages of the prior known fastening systems for ready-to-assemble furniture by providing a reliable system for quickly interconnecting the components of the furniture piece without tools allowing assembly and disassembly as needed.

As is typical of ready-to-assemble furnishings, the upholstered seat of the present invention includes a pair of arm sections, a back section secured to both arm sections and a front section also secured to the arm sections along the front of the seat. The furniture piece of the present invention is designed to support either a seat platform or a fold-out bed platform within the four sections of a piece. The interconnection between the four sections and support of the platform are accomplished through the fastening system embodying the present invention. A pair of side support rails are mounted to an inner surface of the arm sections. The support rails include a front bracket for attaching the front section and a rear bracket for attaching the rear section. The elongated rail therebetween provides a support surface for the side edges of the seat platform.

The front bracket of each rail includes a flange disposed perpendicular to the inner surface of the arm section and having a plurality of keyhole openings adapted to receive locking pins secured to the front section. The rear bracket of the rails includes a support pin extending inwardly perpendicular to the inner surface and an adjustable incline pin for supporting the back section. The support pins are received within hooks secured to the back section to properly connect the back to the arm sections. The incline pin allows adjustment of the slope for the back rest according to user comfort. Upon assembly of the four sections, the seat or bed platform is inserted for support by the rails extending along each of the arm sections.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
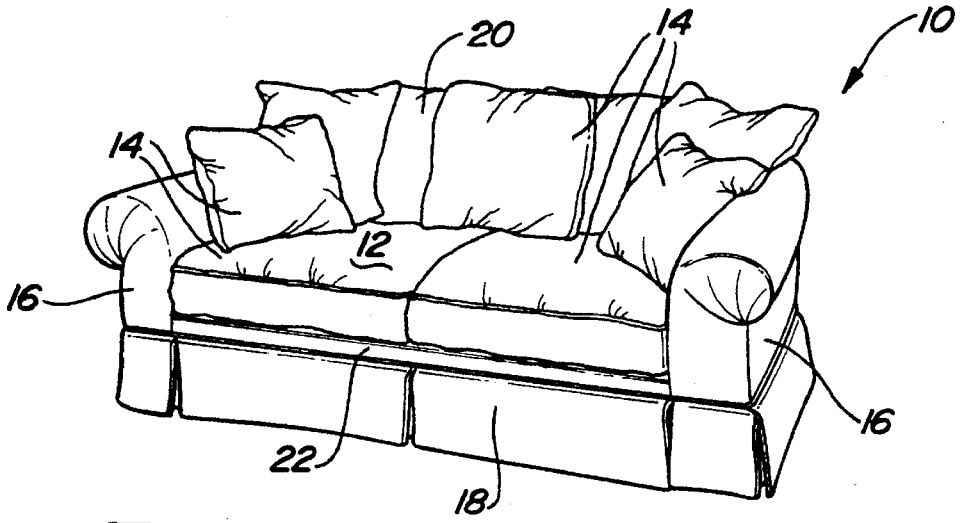
FIG. 1 is a perspective view of a knock-down furniture piece embodying the fastening system of the present invention.

Referring first to FIG. 1, there is shown a furniture piece 10 in the nature of a sofa having a seating area 12 with a selection of cushions and pillows 14 for comfort. The sofa 10 depicted in the drawings is intended for illustration purposes only as the fastening system of the present invention could be used with a variety of furniture pieces. The sofa 10 is of a ready-to-assemble or knock-down type which allows selective assembly and disassembly for delivery, storage or moving of the furniture piece 10. In a preferred embodiment, the ready-to-assemble furniture piece 10 includes side arm sections 16, a front section 18, a back section 20 and a platform 22. The platform 22 supported within the piece may be either a seat platform or a fold-out bed platform which supports the cushions 14 for seating purposes.

Referring now to FIGS. 2 through 7, the sections of the sofa 10 are assembled in a simple and convenient manner which facilitates subsequent disassembly without the need for tools. An integral fastening system is employed to attach the sections of the furniture piece forming the sofa 10. The fastening system comprises a pair of identical side support rails 30 each mounted to an inner surface 32 of the arm sections 16. The support rails 30 are secured to the arm sections 16 using conventional fasteners 34 parallel to the bottom of the furniture piece 10 in order to support the seating platform parallel to the floor. The side support rails 30 each include a support beam 34 having a front bracket 36 and a rear bracket 38. The beam 34 provides support along the edges of a seat or bed platform 22. The front brackets 36 facilitate attachment of the front section 18 to the arm sections 16. The rear brackets 38 facilitate attachment of the back section 20 to the arm sections 16. The one-piece construction of the support rails 30 provides simple attachment of the fastening system to the ready-to-assemble furniture piece 10.

The support beam 34 is a channel beam with a substantially U-shaped configuration. The beam 34 includes a longitudinal support surface 40 upon which the seat platform 22 rests. In the event the pull-out sleeper platform is utilized (FIGS. 3 & 4), a side rail 42 of the sleeper 22 is attached to the side support 30. The rear of the sleeper rails 42 include longitudinal notches which receive side pins 44 on the rear brackets 38. As the sleeper 22 is moved rearward, the side pins 44 engage the notches preventing further rearward movement of the sleeper platform 22. Similarly, the front end of the sleeper rails 42 include longitudinal notches 46 which align with threaded bore 48 in the side supports 30. Upon insertion of the sleeper platform 22 as will be subsequently described, bolts 50 are manually threaded into the opening 48 preventing forward movement of the sleeper platform 22. Thus the seating platform 22 is entirely supported by the side support rails 30 attached to the arm sections 16.

Figure 5:
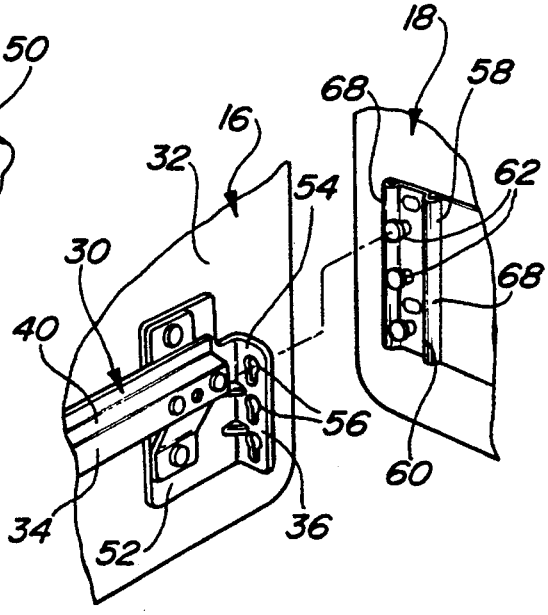
FIG. 5 is an enlarged view of the front bracket of the rail showing the front section connection to the side section.

The front section 18 of the sofa 10 is connected to the arm sections 16 through the front brackets 36 of the side support rails 30. The front brackets 36 include a base plate 52 used to secure the side supports 30 to the arm section 16 and a flange 54 formed perpendicular to the base plate 52 at the forward ends of the support rails 30. The flange 54 preferably has a plurality of vertically aligned apertures 56 for attaching the front section 18. In a preferred embodiment, the apertures 56 have a keyhole configuration with a reduced diameter lower portion. The front section 18 is provided with a pair of end brackets 58 adapted to matingly engage the front bracket 36 of the support rail 30 (FIG. 5). These end brackets 58 include a base 60 and a plurality of vertically aligned locking pins 62 adapted to be received within the apertures 56 of the front bracket 36. The locking pins 62 include a head portion 64 and a neck portion 66. The head portion 64 is received through the apertures 56 to allow the neck 66 to slide into the reduced diameter portion of the apertures 56 preventing withdrawal of the locking pins 62 from their respective apertures 56. The end brackets 58 of the front section 18 also include a pair of ribs 68 which engage the flange 54 upon insertion of the pins 62 to create an interference fit providing stability to the interconnection. Thus, the front section 18 is entirely supported by the side support rails 30 mounted to the arm sections 16.

The rear section 20 of the furniture piece is connected to the arm sections 16 through the rear brackets 38 of the side support rails 30. The rear brackets 38 include a base plate 70 utilized to secure the side support rails 30 to the arm sections 16. A mounting flange 72 is formed integral with and parallel to the base plate 70 of the rearward edge thereof. The mounting flange 72 is provided with an engagement pin 74. The side pins 44 are mounted to the base plate 70 of the rear bracket 38. Formed at an upper end of the base plate 70 is an adjustment knob 76 to adjust the angle of the back rest of the furniture piece 10. In a preferred embodiment, the knob 76 includes a rotatably adjustable pin 78 to vary the distance from the upright back section 20.

Figure 2:
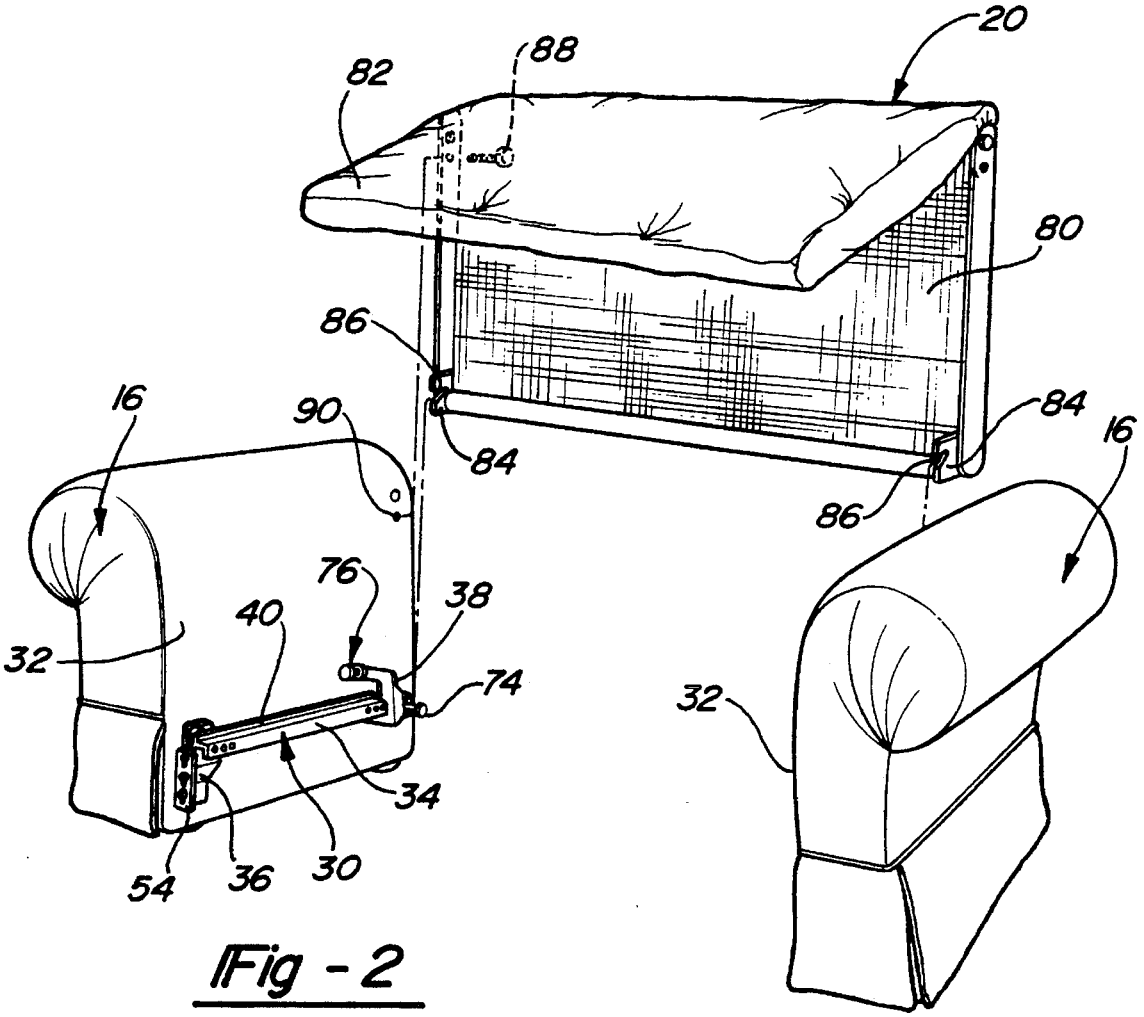
FIG. 2 is an exploded view of the furniture piece showing connection of the back section to the arm section.
Figure 3:
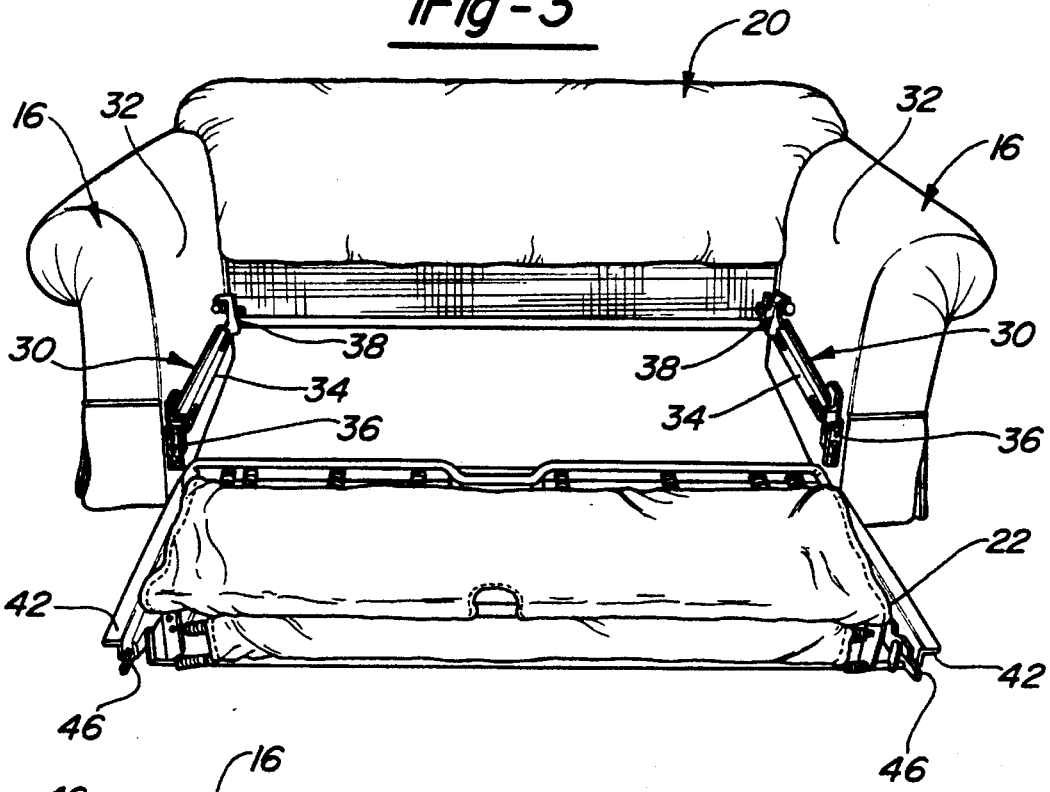
FIG. 3 is a front view 1 of the furniture piece showing the sleeper platform mounted therein.
Figure 4:
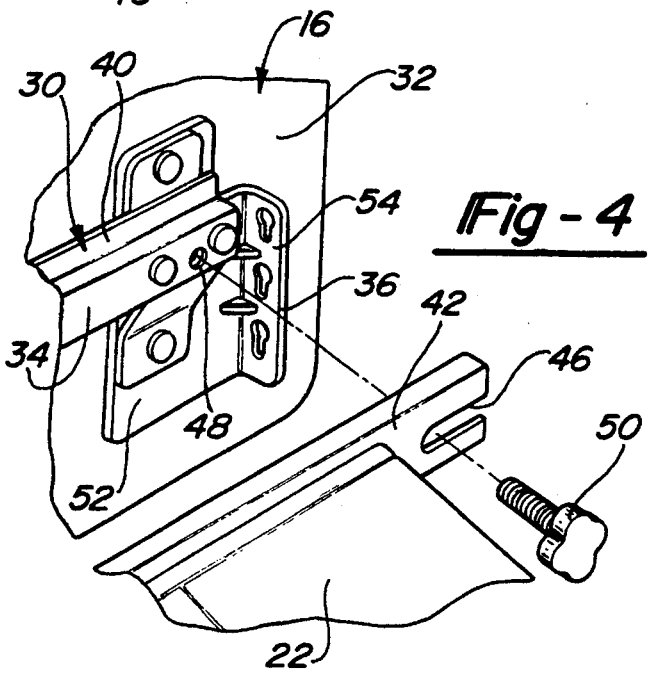
FIG. 4 is an enlarged view of the front bracket of the rail with the sleeper platform secured thereto.

As best shown in FIG. 2, the back section 20 includes an upright portion 80 and a backrest portion 82 pivotably attached to the top of the upright portion 80. Hooks 84 are mounted to the lower end of the upright portion 80. The hooks 84 include a diagonal notch 86 adapted to receive the engagement pins 74 such that the back section 20 is supported by the side support rails 30 on the arm sections 16. The back section 20 is also connected to the arm sections 16 by hand bolts 88. The backrest 82 can then be pivoted downwardly to be supported by the adjustment knob 76. Thus, the back section 20 is entirely supported by the side support rails 30 mounted to the arm sections 16. As an alternative, the notch 86 may be formed in the hook 84 substantially perpendicular to the floor or coplanar with the back 20 rather than at an angle. This allows the back section 20 to be laid on the floor for connection to the pegs 74 and then pivoted upwardly for attachment of the hand bolts 88 to simplify assembly.

The fastening system of the present invention provides a simple and reliable means of interconnecting the components of the ready-to-assemble furniture piece 10 and comprises almost entirely the side support rails 30 mounted to the inner surface 32 of each arm section 16. To assemble the knock-down furniture piece 10, the arm sections 16 having the side support rails mounted thereto are erected with their respective inner surfaces 32 facing. As shown in FIG. 2, the back section 20 is inserted therebetween such that the hooks 84 engage the pins 74 or the rear bracket 38 of the support rails 30. The hard bolts 88 are fed through the sides of the back section 20 to threadably engage apertures 90 in the arm sections 16. In the event the sleeper platform 22 is to be utilized, the sleeper is positioned with the side rails 42 on the beam 34 and slid rearwardly until the notch engages the side pins 44 on the side support rails 30. The bolts 50 can be inserted to attach the sleeper 22 to the side support rail 30 allowing unfolding of the sleeper.

Figure 6:
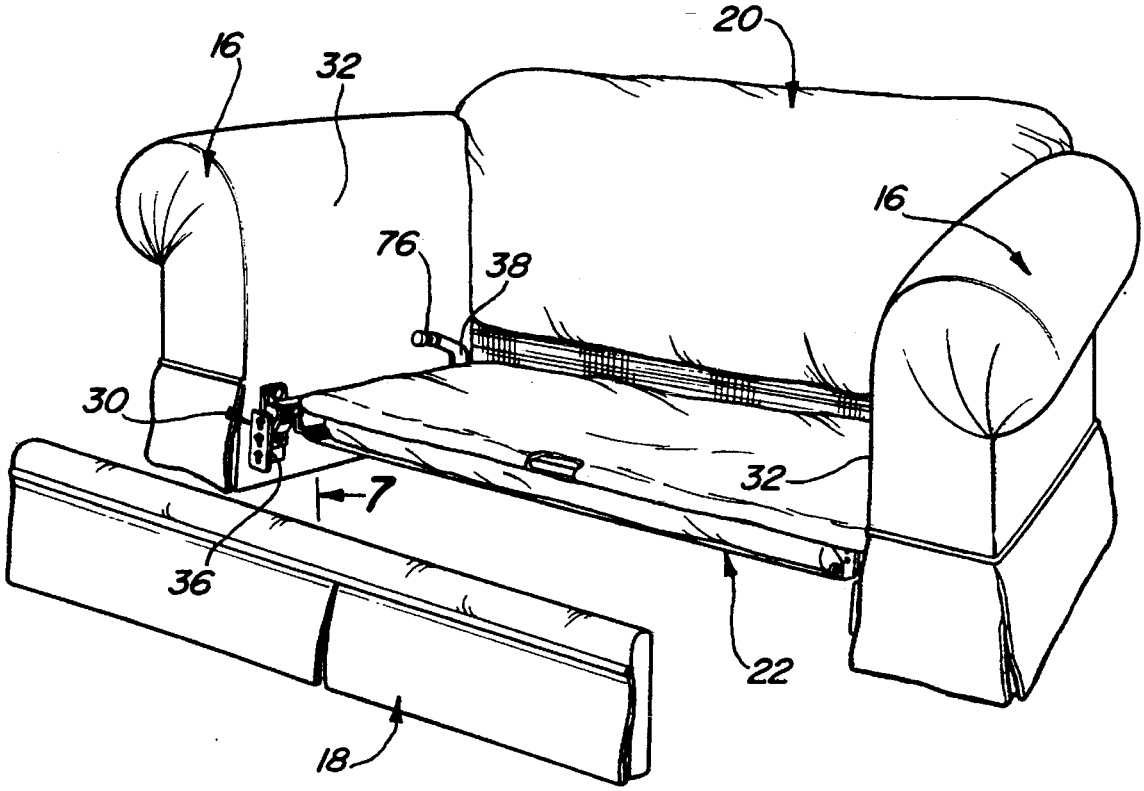
FIG. 6 is a perspective view of the furniture piece showing the front section attaching to the side sections.
Figure 7:
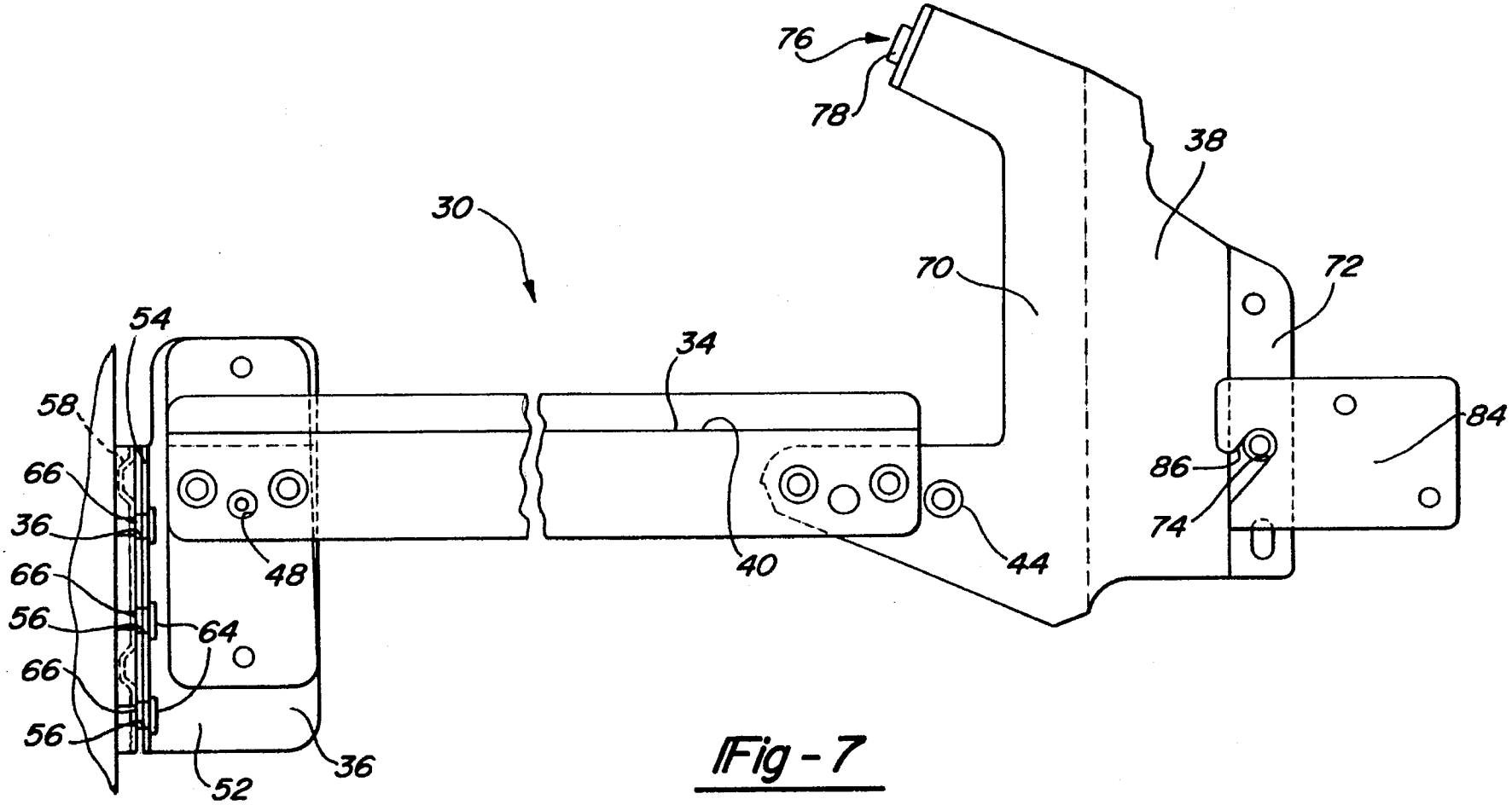
FIG. 7 is a partial view of a side support rail forming a part of the fastening system.

The front section 18 is attached as shown in FIGS. 5 and 6. The locking pins 62 on the front section 18 are aligned with and inserted into the keyhole apertures 56 on the front bracket 36. Pushing down on the front section 18 will force the necks 66 of the locking pins 62 into the reduced diameter portion of the apertures 56 interconnecting the front section to the arm sections 16. If the sleeper was not utilized, the seat platform 22 can be inserted by pushing the platform into the side supports 30 until it is as far back as possible and then allowing it to rest on the beams 34 of the side supports 30. Accordingly, a stable and reliable knock-down furniture piece 10 is formed utilizing the fastening system of the present invention.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a ready-to-assemble furniture piece which can be selectively assembled and disassembled, the furniture piece having a plurality of components including a pair of opposing arm sections, a back section, a front section and platform means for supporting a user of the furniture piece, the improvement comprising:

a fastening system for interconnecting the components of the furniture piece, the fastening system including a pair of integrally constructed side support rails secured to an inside surface of the arm sections, each said side support rail having a rail member supporting said platform means, a front bracket for attaching the front section to said arm sections, and a rear bracket for attaching the back section to said arm sections, said rear bracket including an axially adjustable knob formed at an upper end of said rear bracket, said adjustable know selectively extendable to support a back rest portion of the back section of various inclinations whereby the back section, front section and platform means are supported by said side support rails attached to the arm sections.

2. The furniture piece as defined in claim 1 wherein said rail member is formed by a longitudinal beam extending between said front and rear bracket, said beam having a longitudinal upper support surface upon which said platform means rests, said platform means having side rails adapted to engage said upper support surface of said longitudinal beam thereby supporting said platform means.

3. The furniture piece as defined in claim 2 wherein said side support rail includes means for removably fastening said platform means onto said rail member.

4. The furniture piece as defined in claim 2 wherein said front bracket of said side support rails includes a base plate connected to said rail member and a flange plate disposed perpendicular to said base plate for engagement with the front section of the furniture piece.

5. The furniture piece as defined in claim 4 wherein said flange plate of said front bracket includes a plurality of vertically-aligned apertures, said apertures receiving locking pins on the front section of the furniture piece to attach the front section to the arm sections.

6. The furniture piece as defined in claim 5 and further comprising means for creating interference between said flange plate and the front section to retard removal of said locking pins from said corresponding apertures.

7. The furniture piece as defined in claim 6 wherein said means for creating interference between said flange plate and the front section includes at least one rib formed on one of said flange plate and said front section to retard removal of said locking pin from said flange plate of said front bracket.

8. The furniture piece as defined in claim 4 wherein said rear bracket of said support rails includes a base plate connected to said rail member and a mounting flange extending from said base plate, said mounting flange having an engagement pin selectively engaging support means on the back section for supporting the back section of the furniture piece.

9. The furniture piece as defined in claim 7 wherein the back section includes a hook adapted to receive said engagement pin of said rear bracket such that said back section is supported on said rear bracket.

10. In a ready-to-assemble furniture piece which can be selectively assembled and disassembled, the furniture piece having a plurality of components including a pair of opposing arm sections, a back section, a front section, and platform means for supporting a user of the furniture piece, a fastening system for interconnecting the components of the furniture piece comprising:

a pair of integrally constructed side support rails each secured to an inside surface of the arm sections, each said side support rail having an intermediate rail member supporting said platform means, a front bracket for attaching the front section to said arm sections, and a rear bracket for attaching the back section to said arm sections, said rear bracket including an axially adjustable Knob selectively supporting a backrest portion of the back section at selected inclinations, wherein the back section, front section and platform means are supported by said side support rails attached to the arm sections.

11. The fastening system as defined in claim 10 wherein said rail member is formed by a longitudinal beam extending between said front an rear bracket, said beam having a longitudinal upper support surface upon which said platform means rests, said platform means having side rails adapted to engage said upper support surface of said longitudinal beam thereby supporting said platform means.

12. The fastening system as defined in claim 11 wherein said front bracket of said side support rails includes a base plate extending from said rail member and a flange plate disposed perpendicular to said base plate for locking engagement with the front section of the furniture piece.

13. The fastening system as defined in claim 12 wherein said rear bracket of said side support rails includes a base plate extending from said rail member and a mounting flange, said mounting flange having an engagement pin for supporting the back section of the furniture piece, said back section including hook means engaging said engagement pin of said rear bracket.

14. The fastening system as defined in claim 13 wherein said one of said front bracket and the front section include at least one rib for creating an interference to retard disengagement of the front section from said fastening system.

15. A fastening system for interconnecting components of a furniture piece, the components including a pair of opposing arm sections, a front section, a back section and platform means for supporting a user of the furniture piece, said fastening system comprising:

a pair of integrally constructed side support rails, one of said side support rails secured to an inner surface of each of the arm sections, said side support rails having an intermediate rail member supporting the platform, a front bracket for attaching the front section to said arm sections, and a rear bracket for attaching the back section to said arm sections; said rear bracket including means for selectively adjusting an inclination of a back rest portion of the back section formed at an upper end of said rear bracket, said front and rear brackets secured to said inner surface of said arm sections and having said rail member extending therebetween wherein the back section, front section and platform means are all supported by said side support rails attached to the arm section.

16. The fastening system as defined in claim 15 wherein said rail member is formed by a longitudinal beam extending between said front and rear bracket, said beam having a longitudinal upper support surface upon which said platform means rests, said platform means having side rails adapted to engage said upper support surface of said longitudinal beam thereby supporting said platform means.

17. The fastening system as defined in claim 16 wherein said front bracket of said side support rails includes a base plate extending from said rail member and a flange plate disposed perpendicular to said base plate for locking engagement with the front section of the furniture piece.

18. The fastening system as defined in claim 17 wherein said rear bracket of said side support rails includes a base plate extending from said rail member and a mounting flange, said mounting flange having an engagement pin for supporting the back section of the furniture piece, said back section including hook means engaging said engagement pin of said rear bracket.

19. The fastening system as defined in claim 18 wherein said means for adjusting including an adjustment knob axially adjustable for selectively supporting a back rest portion of the back section.

* * * * *